United States Patent [19]

Johnson

[11] 4,015,689

[45] Apr. 5, 1977

[54] ELEVATOR SYSTEM SAFETY BRACE DEVICE

[75] Inventor: Ronald Johnson, Chicago, Ill.

[73] Assignee: Lawrence Peska Associates, Inc., New York, N.Y.

[22] Filed: Mar. 13, 1975

[21] Appl. No.: 558,057

[52] U.S. Cl. ..... 187/62; 187/79

[51] Int. Cl.[2] ..... B66B 5/06

[58] Field of Search ..... 187/1 R, 67, 73, 75, 187/90, 98, 62–66, 32, 39, 40, 41, 77, 79, 89; 73/488, DIG. 11; 324/178; 318/480

[56] References Cited

UNITED STATES PATENTS

| | | | |
|---|---|---|---|
| 969,557 | 9/1910 | Norris | 187/79 X |
| 982,333 | 1/1911 | Wilson | 187/79 X |
| 1,002,048 | 8/1911 | Faulkner | 187/68 |
| 1,562,117 | 11/1925 | Monroe | 187/77 X |
| 2,511,697 | 6/1950 | Clift | 187/90 |
| 3,474,886 | 10/1969 | Iordanidis | 187/39 X |

*Primary Examiner*—Evon C. Blunk
*Assistant Examiner*—James L. Rowland
*Attorney, Agent, or Firm*—C. Gordon McBride

[57] ABSTRACT

An elevator safety construction in which detent means is provided to block any elevator from falling more than one floor in free fall from such accidents as breakage of the supporting lift cables of the elevator in its shaft. Each floor of the building has its own safety blocking brace normally extending into the path of the descending elevator to block its path therepast. Timing mechanism times the speed of the elevator car and as long as it is lower than the predetermined car descent speed, each of the successive blocking braces is withdrawn, allowing the car to descend successively past each brace. If, however, the descent speed of the car is excessive, then lower braces are not withdrawn and the car cannot move past them, thus blocking crashes and injuries or fatalities to occupants.

5 Claims, 2 Drawing Figures

ELEVATOR SYSTEM SAFETY BRACE DEVICE

This invention relates to improvements in safety devices for elevators used in buildings and the like.

An object of the invention is to provide a novel and improved safety device for elevators to block their free fall in the elevator shaft if the suspension cables should break.

Another object of the invention is to provide a novel and improved elevator safety brace device which is installed in the elevator shaft at spaced intervals, such as at each floor, and extends into the shaft into the downward normal path of the elevator car, so that the car cannot move past the safety brace device until the brace device is drawn out of the path of the car.

A further object of the invention is to provide a novel and improved elevator safety device and system, for use in elevator shafts, in which a series of spaced elevator support braces are mounted in the shaft, one for each floor of the building, each support brace being capable of supporting the elevator against downward movement when the brace is in its normal extended position in the path of the elevator, and including brace retracting means for retracting the brace when the speed of the elevator indicates that it is not falling, and for retracting the safety brace out of the path of the elevator when spaced electric eye means gauge the speed of travel of the elevator car to indicate safe downward passage.

Still another object of the invention is to provide a novel and improved elevator safety device and system in which there are at each floor level area of the elevator shaft, companion mutually vertically spaced first and second lights on one side of the elevator shaft, and mutually vertically spaced selenium cells or other light responsive elements for receiving light from said lights, so that as the elevator moves downwards, it blocks off the first light from its photocell, starting up a timing circuit coupled with the circuit of the lower photocell, and, if the timing shows that the elevator is moving too fast or is in free fall, then the lower photocell circuit holds the safety brace at that floor to block passage of the elevator car therepast, thus giving safety to the car and its occupants.

Still a further object of the invention is to provide a novel and improved elevator safety device and system which can be installed in almost any existing elevator shaft, at relatively low cost, and without interferring with the automatic elevator systems now in use.

The above and other objects and advantages of the invention will become apparent from the following description of a preferred embodiment of the invention as illustrated in the accompanying drawings.

Figure 1:
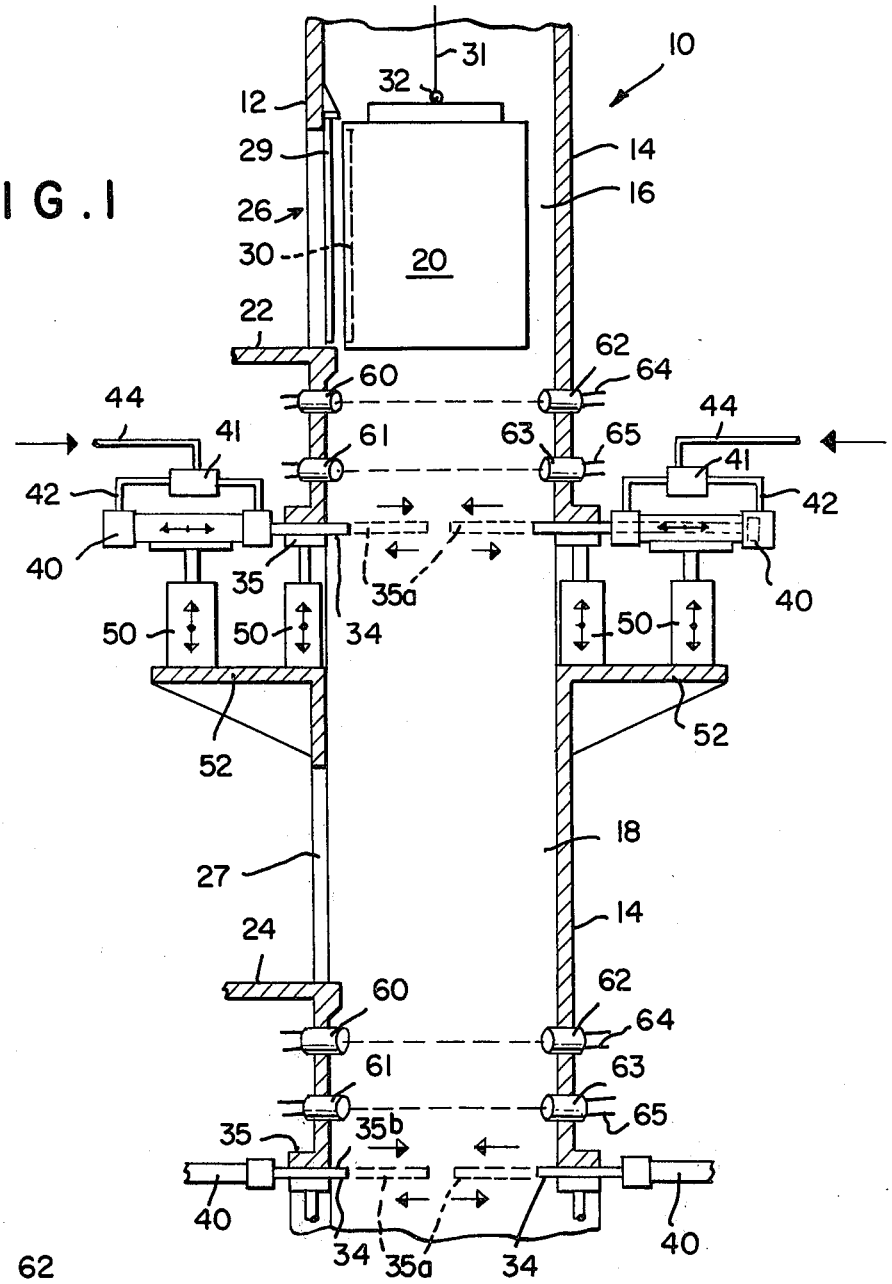
FIG. 1 is a fragmentary sectional elevation of a portion of a building with an elevator shaft for vertical travel in the shaft of the elevator car, and indicating in broken lines extended and retracted positions of the elevator safety braces.
Figure 2:
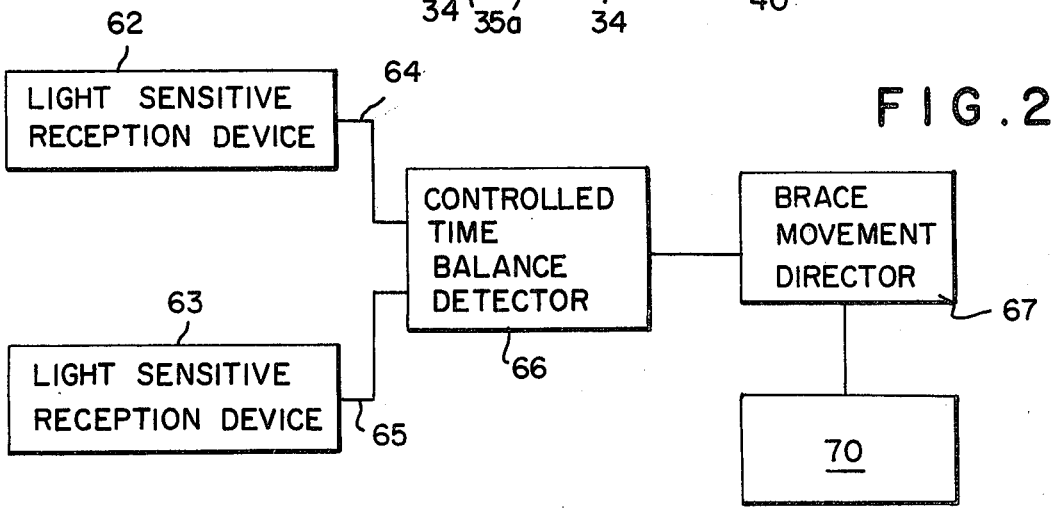
FIG. 2 is a schematic diagram in box form of the electric eye circuitry for controlling the movement of the safety braces between extended and retracted positions.

In the use of elevators in buildings, there has always been a safety factor which led to fears by many persons of entering an elevator for fear that if the lifting cables broke, or the hydraulic lifts formerly in extensive use, failed, then the elevator would enter upon a free fall by gravity action alone, and endanger the lives of its occupants. With the increasing numbers of high rise buildings, going up as high as 110 floors, and having no elevator operator in the car itself, but solely controlled by the occupants and automatic computerized controls, the danger and fears have increased tremendously.

At present, if the elevator cable breaks, or the automatic braking controls fail, there is nothing the occupants of the car can do for their own safety, except to let the car fall to the bottom of the shaft. With the present invention, however, there are safety blocking braces for each floor, which extend into the path of the car, so that the car cannot move past a brace until the brace is retracted out of its path.

At each floor there are two electric lamps aimed across the elevator shaft toward two spaced light sensitive electric eye type cells, one above the other and interconnected by a computer circuit for timing their actuation. When the elevator car passes the first upper light beam it interrupts the first beam to its light cell, and then passes the lower lamp beam to interrupt the second light cell response. If the elevator is falling in a free fall or not a normally specified movement, then the second light cell is interrupted too quickly, and the circuitry blocks retraction of the elevator safety brace at that floor so the car cannot pass. Hence it cannot fall more than one floor.

In order to understand clearly the nature of the invention and the best means for carrying it out, reference may be had to the drawings, in which like numerals denote similar parts throughout the several views.

As shown, there is an elevator shaft 10, with left and right side walls 12 and 14, a rear wall 16, and a front wall, parallel to the wall 16, not shown, to define the vertical shaft passageway 18 through which the elevator car 20 moves vertically from floor to floor, such as from upper floor 22 to next lower floor 24. At each floor there are the usual openings 26 and 27, for example, with the usual floor doors 29 mounted thereon, and the elevator car 20 is also equipped with the usual car door 30 which is to be opened at each floor to allow loading and unloading of passengers and freight as needed.

The elevator car 20 being suspended by cables 31 from lifting drums located in the penthouse of the building and rotated by motors therein to lift the car, it may be that the cables may break or become separated from the supporting eyebolts 32 holding the car to the cables, and the car is then free to fall downwards in the shaft. In order to block such free fall of the car more than one floor, I provide fall blocking support braces 34 at or between adjacent floors, and which normally extend into the elevator shaft from opposite walls of the elevator shaft through guide openings or bearings 35, from their normally extended positions shown in broken lines at **35*a* where they are in the vertical path of the elevator car, to their retracted positions shown in full lines at 35*b***, where they are out of the path of the car.

Since the safety braces, which may be eye-beams or heavy rods, must be movable, they are supported by hydraulic or pneumatic cylinders 40, containing pistons movable by pumps 41 to move the braces in either direction. Pipes 42 are connected to opposite ends of the hydraulic cylinders to move their respective brace rods in inward or outward directions. Electric wire circuits 44 connect to a power source and controls to the pumps 41 for controlling their direction of pumping, and valves are interposed in the pumping constructions to direct the pumping action of the cylinders in one direction or the opposite direction.

Since the safety braces are subjected to the impact of the descending arrested elevator car, and actually support the moving car in its descent, shock absorbers 50 are provided on brackets 52 to absorb the impact shock of arresting the weight of the elevator car, and they may be of any suitable type, such as for example shock absorbers used in motor vehicle work for a graduated delay action within limited time delays. A simple spring action would not do, for it would cause a rebound which would subject the occupants to neck injuries.

While this could all be accomplished by a single person monitoring the movement of the elevator, it is not possible in a multi-floor skyscraper of 50 or more floors, with a dozen or more elevators. Hence, according to the present invention, I provide for each floor an upper light source 60 and a lower light source 61 mounted on opposite sides of the elevator shaft with their respective upper and lower electric eye or selenium cell light sensitive reception members 62 and 63, to receive light beams from the lamps 60 and 61. The objective is to retract from the path of the descending elevator car 20, the motion blocking safety braces 34 so the car can move therepast.

The electric circuitry is such, as is well known in those skilled in the art, that when the elevator car 20 descends past the upper light beam 60, cutting off light to the light sensitive eye 62, the timing circuit is started, to reflect the time for the cutoff by the elevator car of the lower light beam 61 from its eye 63. Wire cables 64 and 65 are fed into the controlled time balance detector 66, which may be a simple well known electric clock movement with a switch to turn it on or off at any given spacing time positions, so that when the upper eye 62 is cut-off from its light beam, the timer operates to be turned off when the elevator car has moved in its normal cycle, and the lower eye 63 actuates the motors 44 to retract the car movement blocking rods 34 to remove them from the path of the elevator car.

However, if the timer shows that the elevator in free fall has blocked the light beam from the lower eye 63 too soon, the controlled time balance detector 66 blocks movement of the brace movement director 67 by any well known circuitry 70, and hence retraction of the car blocking rods 34, so the car cannot fall further. As is well known, the rule of physics is that a body in free fall under gravity force is subjected to acceleration of 32 foot per second$^2$, and while this is of little matter in a fall of a few feet such as about 10 or so feet per floor, it is most important where the fall is about 40 or 50 feet, or about 500 feet or more in view of the tremendously increased speed of the free fall of the object, such as the car.

The present invention seeks to deal with the initial period of the fall, where it is small, and easily dealt with, rather, than as the Fire Departments encounter failure to call the Fire Department immediately to deal with a small fire, rather than a holacust with lives lost needlessly, due to delay. Just to avoid lost one life would make this invention needed and useful.

The description and block and schematic diagrams herein have been presented to describe the invention, and include use of well known electric and electronic circuit and timing circuitry, not set forth in detail as they are well known to those skilled in this art. In a simple form, the device may be equipped at each intermediate floor of the building, with a switch to be turned on when the upper light beam to light cell 62 is interrupted by the descending elevator, the switch connected by wires 64 to turn on a timing clock switch in the balance detector 66, starting the timing cycle, and set to turn on the brace movement director 67 when its set time has expired, such as one-second, or more or less, depending on the preset speed of descent of the particular elevator. If the speed of descent is precisely that pre-set, the passage of the elevator car past light source 61 will cut off the lower light cell 63, and retract the blocking braces out of the path of the car, allowing it to pass.

If the speed of descent is too great, the timing switch in 66 is not actuated, and hence the motion blocking braces are not retracted, and the car cannot descent more than the one floor involved. In other words, this is not a passive car gate, but an active one, which will not open if the car is moving too fast.

Although the invention has been described in specific terms, it is understood that various changes may be made in size, shape, materials and arrangement without departing from the spirit and scope of the invention as claimed.

Having thus described the invention, what I claim as new is:

1. An elevator safety device for use with elevators installed in an elevator shaft in a building or other structure including an elevator car and supporting means for said car for movement in said elevator shaft for movement between floors of said building, comprising: a plurality of safety brace elevator movement blocking means engaging said elevator shaft and extensible into and out of the path for movement of said elevator car for blocking downward movement of said car in said shaft; said safety brace elevator movement blocking means including at least one elongated brace member; support bracket means carried in said elevator shaft for supporting said brace member for movement of said brace member from retracted to extended positions on said support bracket means and including brace member reciprocating means for moving said brace member from extended to retracted positions and back again; brace retaining means for retaining said brace means member in extended normal position to block descent of said elevator car; retracting control means for operating said brace reciprocating means for moving said brace means members into retracted position out of the path of descent of said elevator car whenever said car undergoes less than a predetermined excessive rate of descent in speed; fluid cylinder housing means; piston means in said housing means and connected at one end to a said brace member for movement therewith; valve means for admitting a fluid into said housing means for moving said piston means; fluid pumping means for actuating said piston means; timing control means for actuating said fluid pumping means for moving said piston means and said interconnected brace member from extended car blocking position to retracted car unblocking position whenever said speed of car descent remains below said predetermined rate of speed; and actuating means brought into action upon excessive speed of descent of said car beyond a predetermined speed to actuate said blocking means to prevent retraction thereof and block movement of said car therepast in said shaft.

2. The construction of claim 1, and wherein said fluid cylinder housing means contains a liquid medium in the nature of water and the like.

3. The construction of claim 1, and wherein said fluid cylinder housing means contains a gaseous fluid in the nature of air and the like.

4. An elevator safety device for use with elevators installed in an elevator shaft in a building or other structure including an elevator car and supporting means for said car for movement in said elevator shaft for movement between floors of said building comprising: a plurality of safety brace elevator movement blocking means engaging said elevator shaft and extensible into and out of the path of movement of said elevator car for blocking downward movement of said car in said shaft; said safety brace elevator movement blocking means having at least one elongated safety brace member; brace supporting means engaging said elevator shaft; brace reciprocating means connected with said brace member for moving said brace member into and out of the descent path of said elevator for blocking and unblocking movement of said car; support bracket means carried in said elevator shaft for supporting said brace member for movement of said brace member from retracted to extended positions on said support bracket means whereby when in said retracted position said brace member is wholly positioned out of the path of movement of said elevator car and when in said extended position said brace member is positioned into the path of movement of said elevator car to block descending movement of said car in said shaft; actuating means brought into action upon excessive speed of descent of said car beyond a predetermined speed to actuate said blocking means to prevent retracting thereof and block movement of said car therepast in said shaft; said actuating means having a first light source means forming an upper light beam into said elevator shaft; first light sensitive cell means for receiving light rays from said upper light beam; second light source means forming a lower light beam into said elevator shaft; second light sensitive light cell means for receiving light rays from said lower light beam; timing switching means brought into action on receiving light from said upper light beam and started into timing action on interruption of said upper light beam by passage of said elevator; circuit control means for operating said brace reciprocating means under the influence of said lower light cell means for retracting said brace means out of the path of descent of said elevator car to unblock its passage therepast whenever the rate of descent of said car is lower than said predetermined speed and wherein said circuit control means is maintained in condition to fail to actuate said reciprocating means whenever said rated speed of descent of said elevator car is greater than the predetermined safe speed of descent of said car.

5. The construction of claim 4, and comprising shock absorbing means for underlying said brace member means for absorbing the shock of descent and arrest of downward movement of said elevator car in said suddenly arrested descent.

* * * * *